US010857404B2

(12) United States Patent
Small

(10) Patent No.: US 10,857,404 B2
(45) Date of Patent: Dec. 8, 2020

(54) ISOKINETIC ROPE CLIMBING METHOD AND MACHINE

(71) Applicant: Mark Small, Camp Hill, PA (US)

(72) Inventor: Mark Small, Camp Hill, PA (US)

( * ) Notice: Subject to any disclaimer, the term of this patent is extended or adjusted under 35 U.S.C. 154(b) by 46 days.

(21) Appl. No.: 16/059,218

(22) Filed: Aug. 9, 2018

(65) Prior Publication Data

US 2019/0175972 A1 Jun. 13, 2019

Related U.S. Application Data

(60) Provisional application No. 62/598,240, filed on Dec. 13, 2017.

(51) Int. Cl.
*A63B 7/04* (2006.01)
*A63B 21/002* (2006.01)
(Continued)

(52) U.S. Cl.
CPC ..... *A63B 7/045* (2013.01); *A63B 21/002* (2013.01); *A63B 21/008* (2013.01);
(Continued)

(58) Field of Classification Search
CPC ..... A63B 7/045; A63B 21/169; A63B 21/002; A63B 21/008; A63B 21/157;
(Continued)

(56) References Cited

U.S. PATENT DOCUMENTS 641,519 A * 1/1900 Kerns ..... A63B 7/04 482/119
3,782,718 A * 1/1974 Saylor ..... A63B 7/04 482/37

(Continued)

OTHER PUBLICATIONS

Screen captures from YouTube video clip entitled "Pressure Compensated Flow Control—Part 1," 9 pages, uploaded on Mar. 6, 2017 by user "LunchBox Sessions". Retrieved from Internet: https://www.youtube.com/watch?v=mCPJvrEiXCA (Year: 2017).*

(Continued)

*Primary Examiner* — Megan Anderson
*Assistant Examiner* — Kathleen Vermillera
(74) *Attorney, Agent, or Firm* — Hilary J. Sumner

(57) ABSTRACT

An endless loop rope climbing machine that maintains a constant rope speed through a hydraulic resistance mechanism. This method and device uses a climbing rope threaded about a tapered friction sheave connected to a hydraulic pump via a shaft. The user selects a desired fluid flow rate corresponding to a preferred rope climbing speed using a flow adjustment mechanism. Force exerted on the rope by the climber initiates the flow of fluid through the hydraulic system. Fluid is propelled through the system to a pressure compensated flow control (PCFC) valve in fluid communication with the hydraulic pump. A pressure compensating spool within this PCFC valve shifts in position to regulate fluid flow, returning a constant velocity of fluid to the hydraulic pump. The shaft connected to the hydraulic pump rotates at a consistent speed regardless of the force applied by the climber, thereby maintaining the steady rope climbing speed selected by the user.

10 Claims, 11 Drawing Sheets

(51) Int. Cl.
*A63B 21/008* (2006.01)
*A63B 21/00* (2006.01)
*A63B 21/015* (2006.01)
*A63B 21/16* (2006.01)

(52) U.S. Cl.
CPC ..... *A63B 21/00069* (2013.01); *A63B 21/015* (2013.01); *A63B 21/157* (2013.01); *A63B 21/169* (2015.10); *A63B 2208/0204* (2013.01); *A63B 2208/0233* (2013.01)

(58) Field of Classification Search
CPC ..... A63B 21/00069; A63B 21/015; A63B 2208/0204; A63B 2208/0233; F16C 3/00; F16C 3/02; G05D 16/028; G05D 16/04; G05D 16/10; G05D 16/101; G05D 16/103; F04B 23/02; F04B 9/14; F04B 49/00; F04B 49/002; F04B 49/20; F04B 49/22; F04B 2205/09; F04C 14/00; F04C 14/08; F04C 14/24; F04D 15/0005; F04D 15/0022; F04D 15/0027; F04D 15/0066; F04D 15/02; F04D 15/0209; F04D 15/0281; Y10T 137/85954
USPC ..... 137/505–505.47, 563, 565.01–565.11, 137/565.13, 565.15
See application file for complete search history.

(56) References Cited

U.S. PATENT DOCUMENTS 4,846,466 A 7/1989 Stima, III
5,060,938 A * 10/1991 Hawley, Jr. ..... A63B 7/04 482/119
5,076,574 A * 12/1991 Johnson, Jr. ..... A63B 7/04 482/112
5,496,234 A * 3/1996 Sussich ..... A63B 7/04 482/114
7,018,323 B1 * 3/2006 Reynolds ..... A63B 7/04 482/112
7,060,003 B1 * 6/2006 Reynolds ..... A63B 7/04 273/451
7,303,506 B1 * 12/2007 Reynolds ..... A63B 7/04 482/112
7,727,118 B1 * 6/2010 McCall ..... A63B 69/0048 482/112
8,307,851 B2 * 11/2012 Warsowe ..... E03C 1/021 137/595
10,016,645 B1 * 7/2018 Reynolds ..... A63B 21/008
2004/0014568 A1 * 1/2004 Williams ..... A63B 7/04 482/37
2005/0148437 A1 * 7/2005 Ryan ..... A63B 21/018 482/37
2007/0270287 A1 * 11/2007 McDonnell ..... A63B 21/00 482/72

OTHER PUBLICATIONS

"Pressure-compensated Flow Control Valves," posted on Jan. 6, 2011, 2 pages, retrieved from the Internet: http://www.valvehydraulic.info/creation-and-control-of-fluid-flow/pressure-compensated-flow-control-valves.html (Year: 2011).*

* cited by examiner

ISOKINETIC ROPE CLIMBING METHOD AND MACHINE

CROSS REFERENCE TO RELATED APPLICATIONS

This application claims benefit of priority from U.S. Provisional Patent Application No. 62/598,240 of Mark Small filed Dec. 13, 2017, entitled ISOKINETIC ROPE CLIMBING METHOD AND MACHINE the entirety of which is incorporated herein by reference.

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

FIELD OF THE INVENTION

The present invention pertains to an exercise apparatus and method used to create a continuous-motion rope climbing machine that maintains a constant rope speed and resistance regardless of the climber's weight or force exerted.

BACKGROUND OF THE INVENTION

Rope climbing offers an effective means for developing strength by placing the climber's arm and back muscles under constant tension while ascending and descending a rope. Leg muscles are also engaged as the climber pinches the rope between his feet to maintain elevation and support the weight of his body while the arms are repositioned to either move up or down the rope.

Rope climbing is often done by affixing a length of rope to an elevated point on a building and the resistance is created by the force of gravity exerted on the climber's mass. This form of rope climbing is inaccessible unless the climber possesses sufficient upper body strength to support his own weight.

Muscle mass is increased by fatiguing and tearing down the targeted muscle fibers and an effective exercise works those muscles to the point of failure. This poses a problem when that fatigue occurs at the top of a rope suspended at an unsafe elevation. A number of rope climbing machines have been designed to avoid this dilemma by offering endless loop climbing machines. These machines are positioned near the ground and allow the climber to ascend and/or descend a length of rope, exercising to failure without the fear of falling.

Rope climbing machines generally create resistance by threading a length of rope through a system of friction and drag mechanisms, employing a plurality of channels, pulleys or hydraulic cylinders and requiring the user to manually tension the device. Other designs use microprocessor controlled systems to set a desired resistance. Both of these approaches are affected by the user's weight and the resistance and rope speed are compromised as greater force is exerted by the climber.

Exercise machines traditionally require the user to move a fixed resistance or weight through a particular range of motion (ROM.) The movement of the device varies in speed throughout the ROM depending on the exercise being undertaken and the resistance system being used. In rope climbing, the climber reaches one arm over the head, grasps the rope and pulls down, advancing the body up the rope length. The opposite arm then reaches above the head to repeat the ROM cycle.

A climber exerts a greater force on the rope when the ROM cycle begins due to the leverage exerted by the arm. The body is hoisted up the rope length, causing the rope to advance more quickly until the climber's gripping hand is at waist level. In a traditional climbing machine this variation in the acceleration of the rope within the resistance mechanism results in non-uniform tensioning. Consequently, the force exerted by the arm at the bottom of the exercise stroke is generally much less than it was at the top of that stroke. This variation in tension of the climber's muscles results in a less efficient form of exercise and may increase the risk of injury.

There is a growing trend in exercise called isokinetics. This is a strength training method that blends the intense muscular contractions experienced in isometric exercise with the full range of motion required in isotonic workouts. Isokinetic machines require the targeted muscle groups to overcome a substantially constant resistance throughout the entire ROM of the exercise. In a rope climbing machine, this is accomplished by generating a constant rope speed regardless of the climber's weight or force exerted. This dynamic tensioning maintains the climber's muscles in a constant state of strain and contraction, accelerating muscle fatigue and consequently assisting in the break down and subsequent rebuilding of stronger muscles.

There have been several attempts to create exercise machines that exert a constant opposing force. U.S. Pat. No. 4,846,466 suggested the regulation of resistance through the use of a microprocessor controlled electro-hydraulic system. The apparatus requires the collection of strength input data to calculate a constant resistance and apply the required opposing force using a solenoid type pressure control valve. The problem with this design is that it calculates the needed resistance by measuring strength input data collected at the beginning of the workout. It then applies the calculated resistance only at fixed application points in the motion of the device's working arm. The user's strength will likely be greater at the beginning of the workout making this calculated resistance excessive as the workout progresses. This device does not compensate for the reduction in muscle strength as the workout progresses and may lead to injury.

U.S. Pat. No. 5,060,938 suggests the use of a series of pulleys and a drum with several circumferential grooves to create a constant opposing force while the machine is use. The climber is required to select a weight and must pull with enough force to lift this weight from a teeterboard to engage a drag mechanism. The device demands a great deal of floor space and requires the user to select and lock the needed weights with a pin system. The need to pull that weight with sufficient force to engage the resistance mechanism may subject the user to injury.

U.S. Pat. No. 7,811,204 suggests the use of a braking system comprised of a motor or governor and a series of springs or weight plates to maintain a constant rope speed by transferring rotational forces from inertial to linear forces.

As the user pulls on the rope, the force rotates a sprocket causing a governor to spin. When excessive force is exerted on this governor a brake disk engages, increasing the resistance within the machine. The friction employed in this mechanical apparatus will eventually wear the braking system making it less effective over time. This machine is overly complex and requires the user to select an offsetting weight; the harder one pulls on the machine, the faster the machine will move. This design is not intended to support the climber's weight and merely engages the user's arms in a cardiovascular workout similar to that of a rowing machine.

There is therefore a need in the art for a less complicated isokinetic rope climbing machine, capable of instantaneously sensing and adjusting the pressure within the system to maintain a constant resistance regardless of the weight or force applied by the climber.

BRIEF SUMMARY OF THE INVENTION

The present invention addresses the problems discussed above by offering a climbing machine that maintains a constant resistance and therefore a constant rope speed for the climber.

A greater weight or force applied by the climber will result in a greater force on the resistance mechanism. A pressure compensated control valve mounted within this mechanism senses any changes in force or weight The application of force or weight of the climber, causes more or less fluid to enter the pressure compensated control valve where a pressure compensating spool is in fluid communication with a pressure adjustment chamber inside the valve. This pressure compensating spool shifts position in response to and in synchrony with an increase or decrease in pressure within the pressure adjustment chamber, consequently allowing or inhibiting rotation of the hydraulic pump shaft. The pressure within this valve regulates the movement of fluid within the hydraulic pump and governs the rotation of the friction sheave to generate a constant rope speed. The movement of the pressure compensating spool within the pressure adjustment chamber maintains a constant pressure drop across the speed adjustment orifice. In a typical hydraulic rope climbing machine the higher the pressure, the higher the flow rate, and the faster the climbing rope will move and vice versa; however, the use of a pressure compensated flow control valve in the present invention ensures that the climbing rope speed will remain constant regardless of pressure.

It is therefore an object of the invention to provide a safe, compact and straight forward method and apparatus that simulates the motion of natural rope climbing while offering a constant rope speed, subjecting the targeted muscle groups to isokinetic resistance. It is a further object of this invention to offer a wide variation in rope speed to accommodate varying abilities of the climbers.

As previously mentioned, isokinetic exercise puts a constant dynamic tension on the targeted muscles. Because the force remains constant, the risk of injury is significantly reduced making this an ideal means for rehabilitation of injured or compromised muscles. In the preferred embodiment, the rope is oriented in the vertical position. A seat may be added to assist those with reduced mobility or a fear of falling. The support structure may also be modified such that the rope is oriented in a horizontal position, allowing the user to pull the rope in a tug-of-war style or alternatively to lie on one's back and pull the rope overhead. Foot holds may also be added to improve the user's stance.

REFERENCE NUMERALS

5 Rope Climbing Machine
10 Resistance Mechanism
15 Climbing Rope
18 Rope Hanger
20 Support Structure
22 Stand Mount
25 Friction Sheave
28 Key
30 Tapered Channel
34 Cavity
35 Guide Sheave
38 Tapered Channel of Guide Sheave
40 Hydraulic Pump
44 Hydraulic Pump Shaft
45 Hydraulic Reservoir
47 Inlet of the Hydraulic Reservoir
49 Outlet of the Hydraulic Reservoir
50 Pressure Compensated Flow Control (PCFC) Valve
55 Flow Adjustment Mechanism
60 Flow Adjustment Control Cable
64 Flow Adjustment Selector
65 Flow Rate Orifice
66 Gear Rack
68 Pinion
70 Flow Rate Orifice Needle

75 Pressure Compensating Spool
80 Check Valve for Non-Compensated Return Flow
85 Variable Pressure Compensating Orifice
90 Entrance Orifice of the PCFC Valve
95 Exit Orifice of the PCFC Valve
100 Pressure Adjustment Chamber
105 Bias Spring
108 Bias Spring Chamber
110 Ball Check Spring
115 Stool
120 Rope Guide
125 Suspended Rope Handling Mechanism

DETAILED DESCRIPTION OF THE INVENTION

In this patent application cords, strings, filaments, cables and flexible chains will be generally referred to as "rope."

Figure 1:
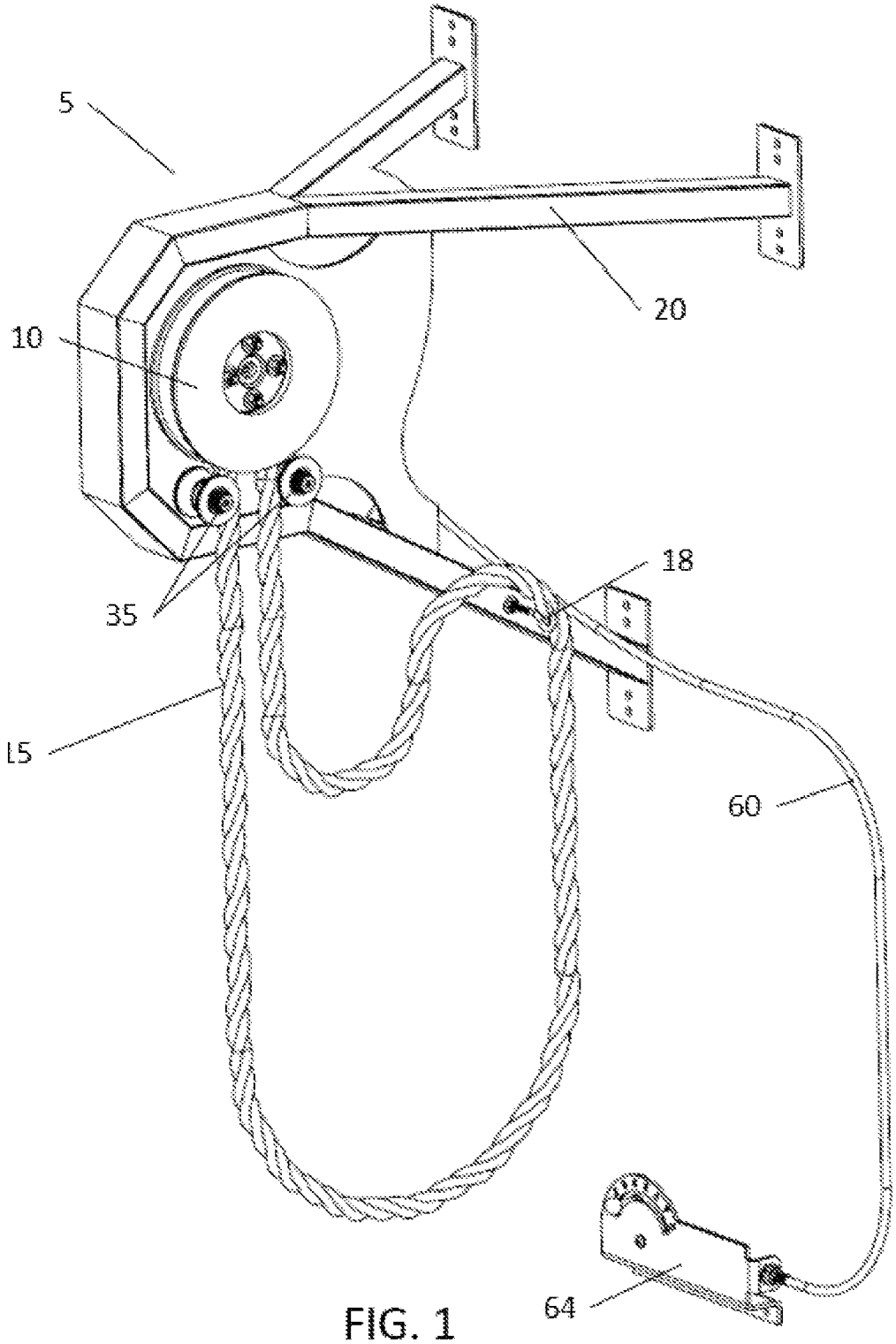
FIG. 1 is right side elevational view of a wall mountable isokinetic rope climbing machine.
Figure 2:
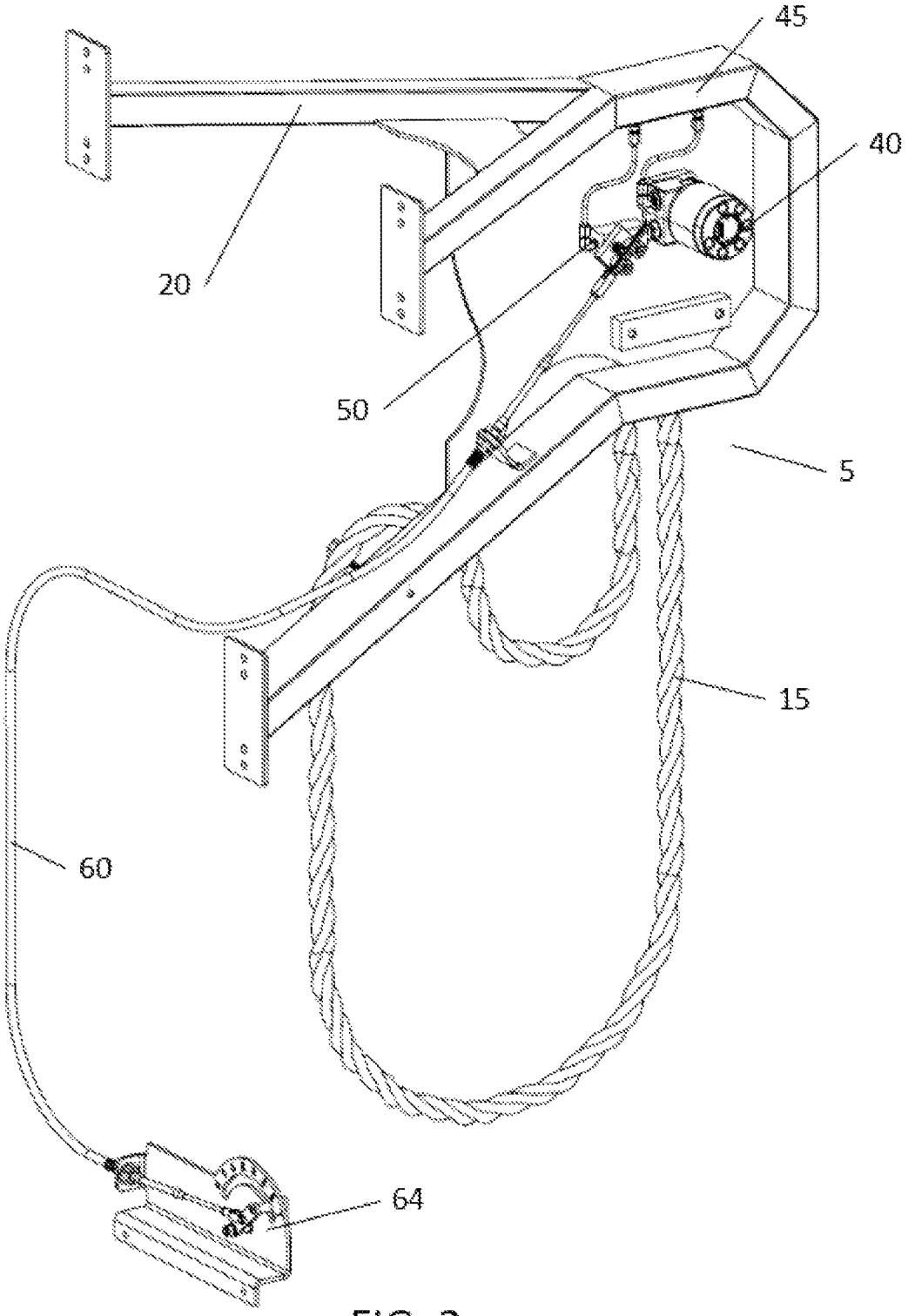
FIG. 2 is a left side elevational view of a wall mountable isokinetic rope climbing machine.
Figure 8:
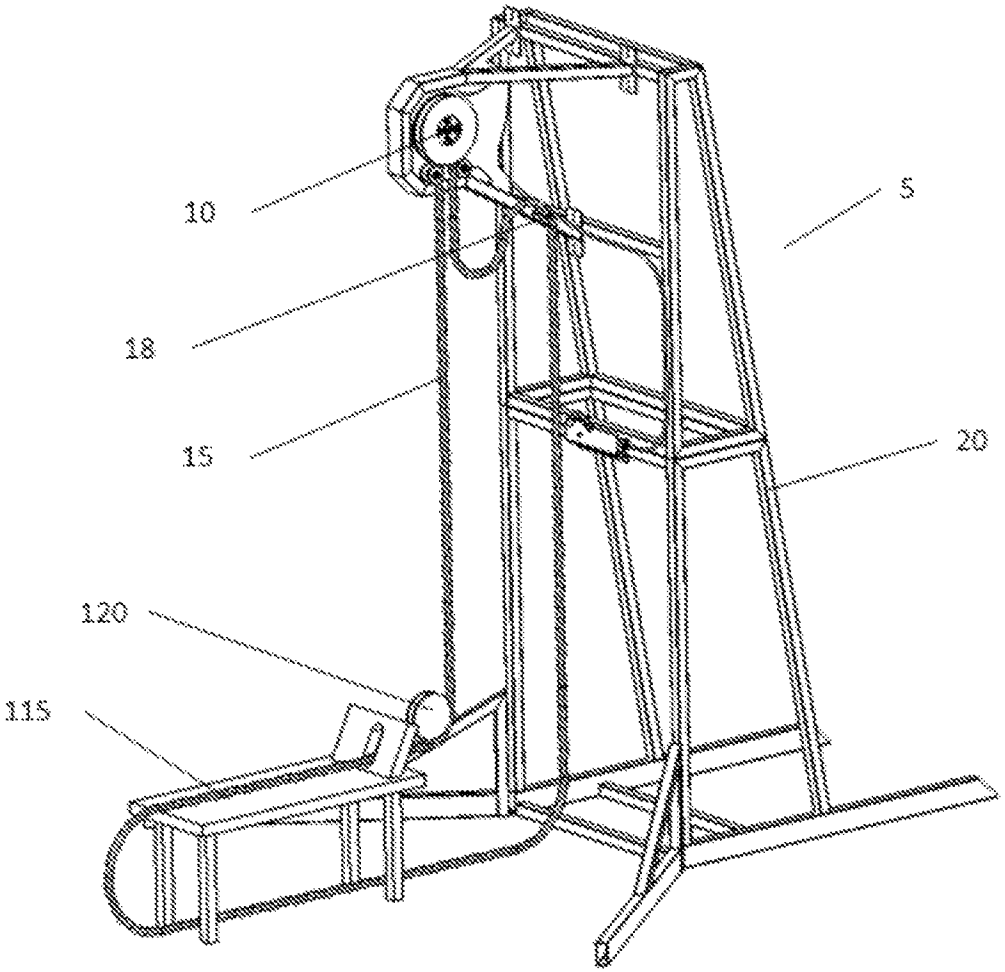
FIG. 8 is a perspective view of stand-mounted isokinetic rope climbing machine having a horizontal rope feed.
Figure 9:
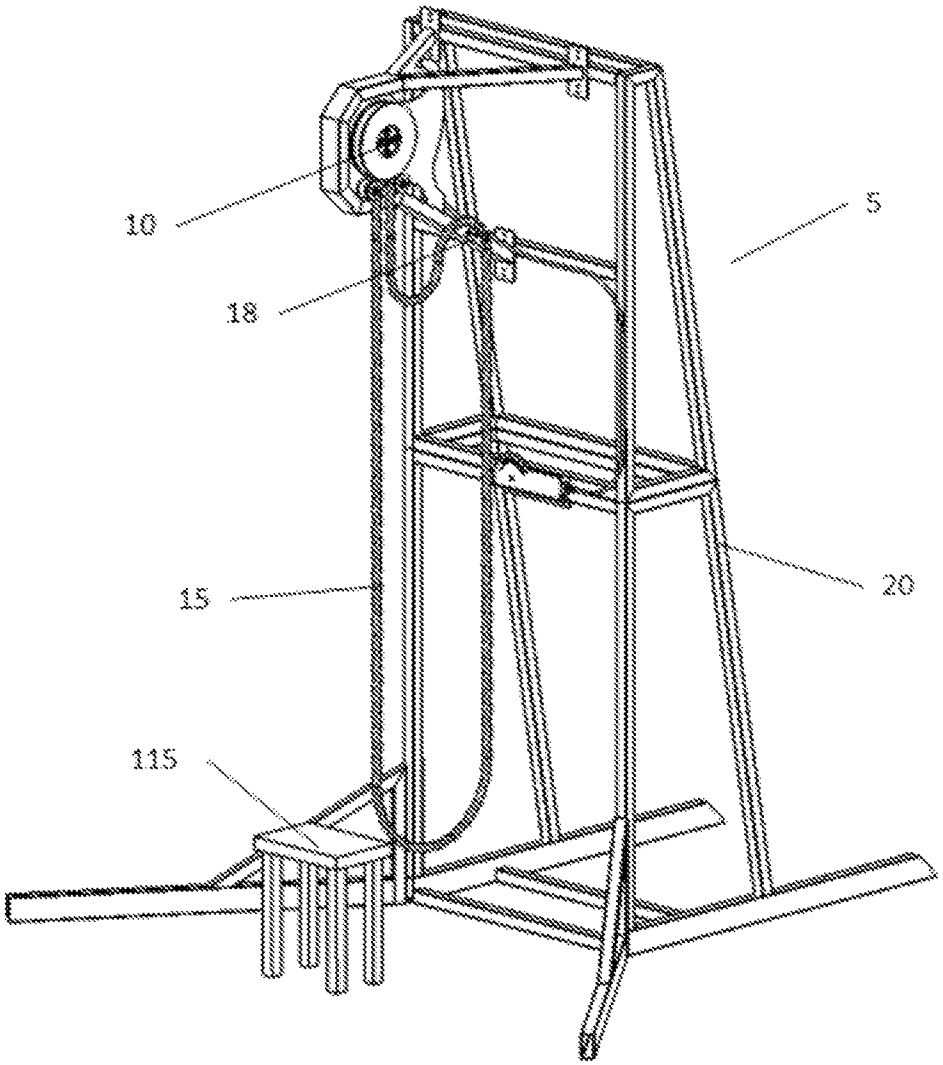
FIG. 9 is a perspective view of a stand mounted isokinetic rope climbing machine having a stool
Figure 10:
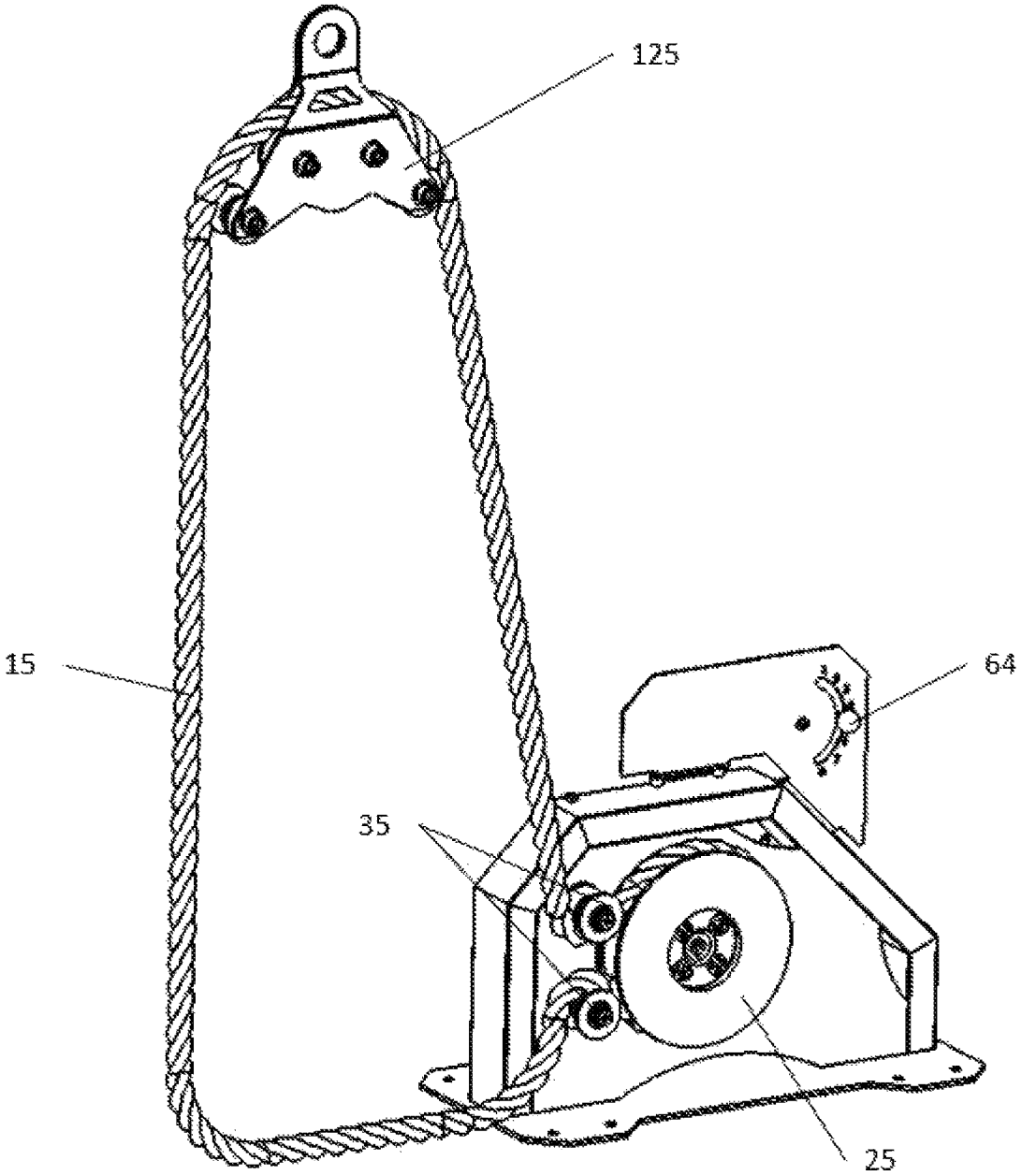
FIG. 10 is a perspective view of a space saving version of the machine having a floor-mounted support structure and a suspended rope handling mechanism.
Figure 11:
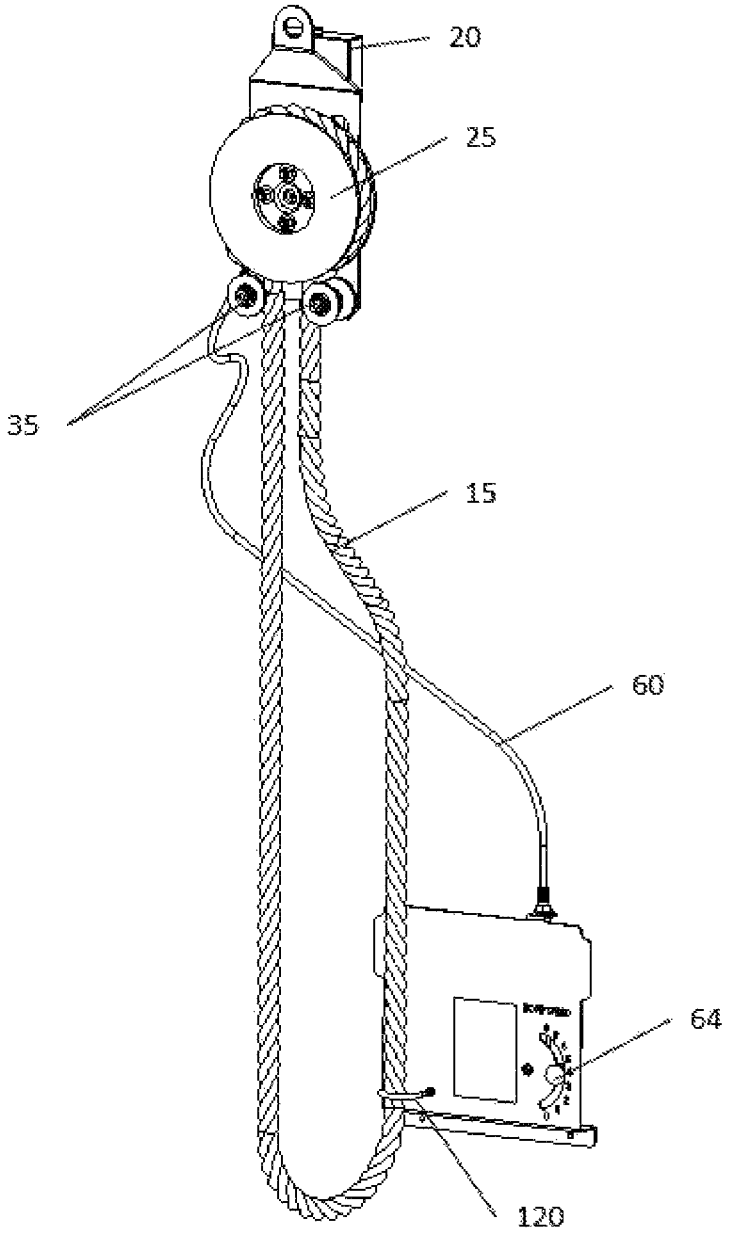
FIG. 11 is a perspective view of a wall-hangable isokinetic rope climbing machine.

Referring to FIGS. 1 and 2, the rope climbing machine 5 is comprised of three main components: a resistance mechanism 10, a climbing rope 15 and a support member 20. The apparatus will be subjected to significant forces; the support member 20 must therefore be configured to withstand these forces through geometry and/or use of materials with a high tensile strength. FIGS. 1 and 2 depict a wall mounted version of the rope climbing machine; however, rope climbing machines having a stand mount 22 with sufficient stability may also be used as shown in FIGS. 8 and 9. Alternatively, a space saving version may be used as depicted in FIG. 10 or a wall hangable version as shown in FIG. 11.

Figure 3:
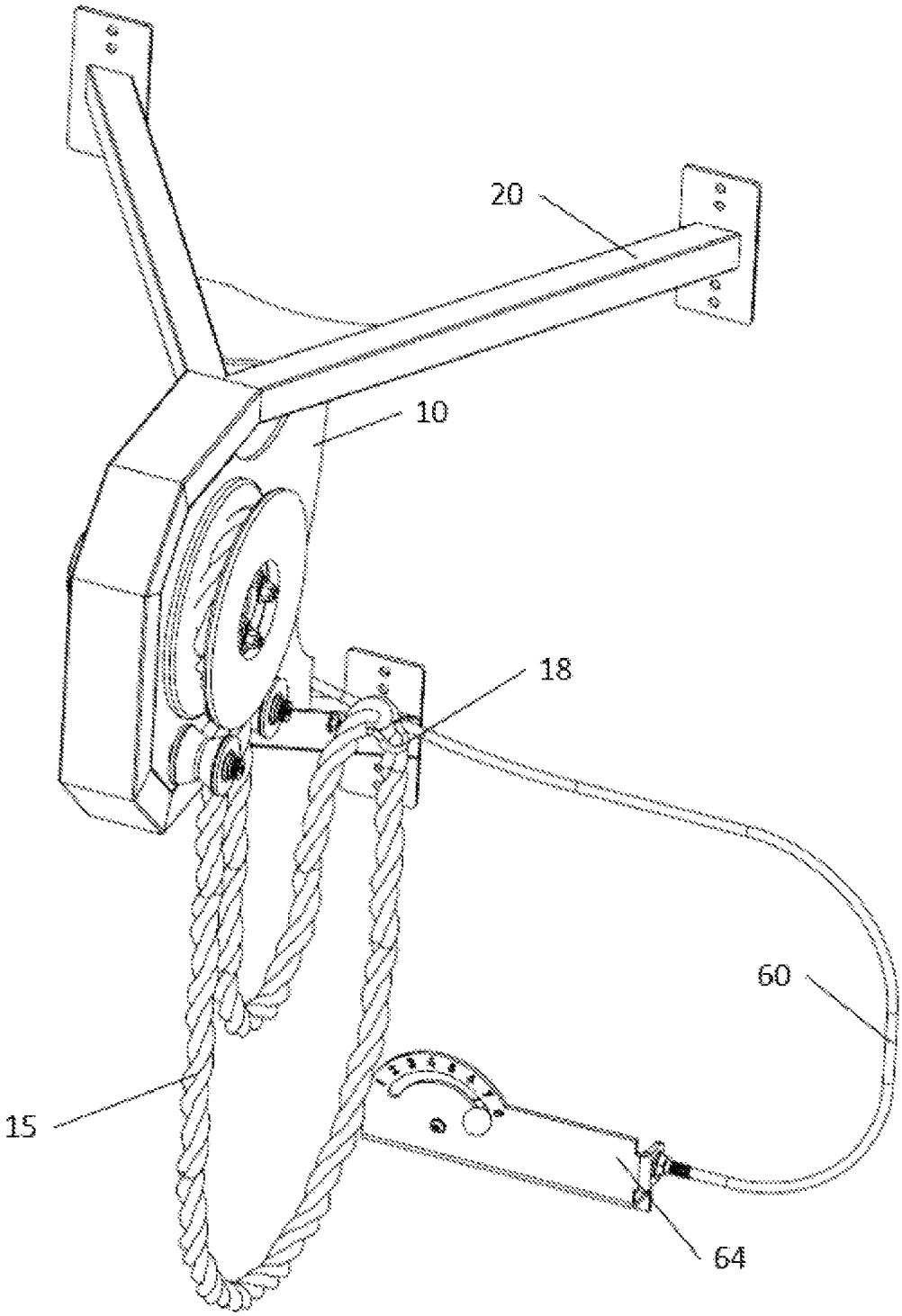
FIG. 3 is a right side elevational view of a wall mountable isokinetic rope climbing machine showing the front of the machine in more detail.
Figure 4B:
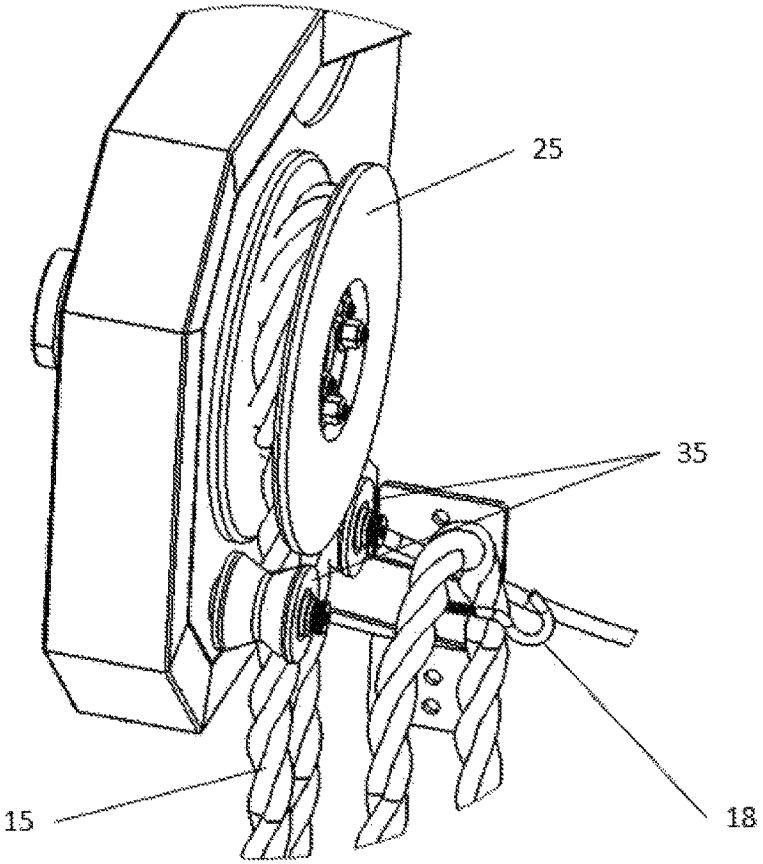
FIG. 4B is a right side elevational view of the resistance mechanism showing the climbing rope seated within the tapered channel of the friction sheave.
Figure 4A:
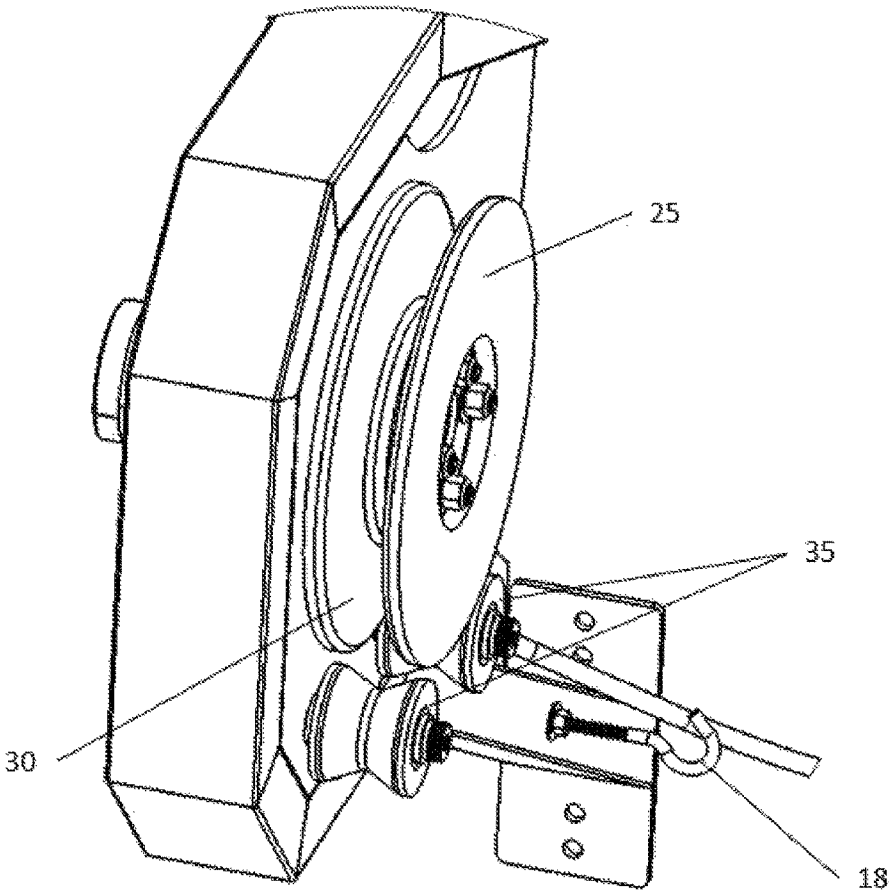
FIG. 4A is a right side elevational view of the resistance mechanism illustrating the friction sheave and tapered channel.
Figure 5B:
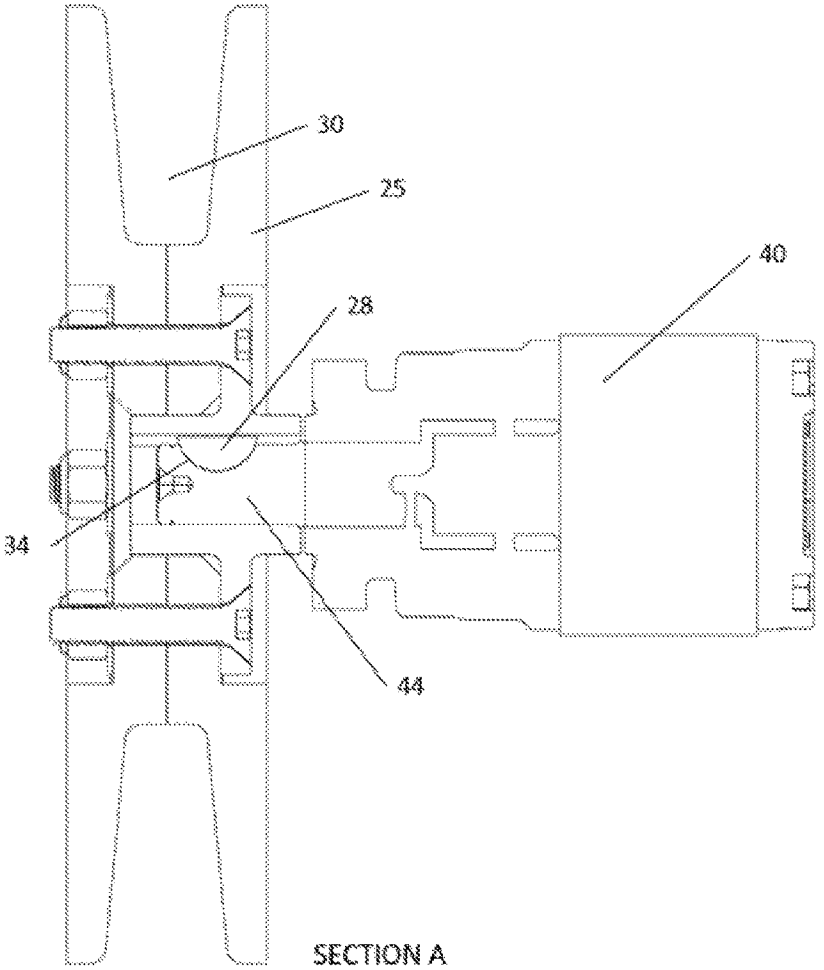
FIG. 5B is a cross-sectional view of the resistance mechanism along section A-A shown in FIG. 5A.
Figure 5A:
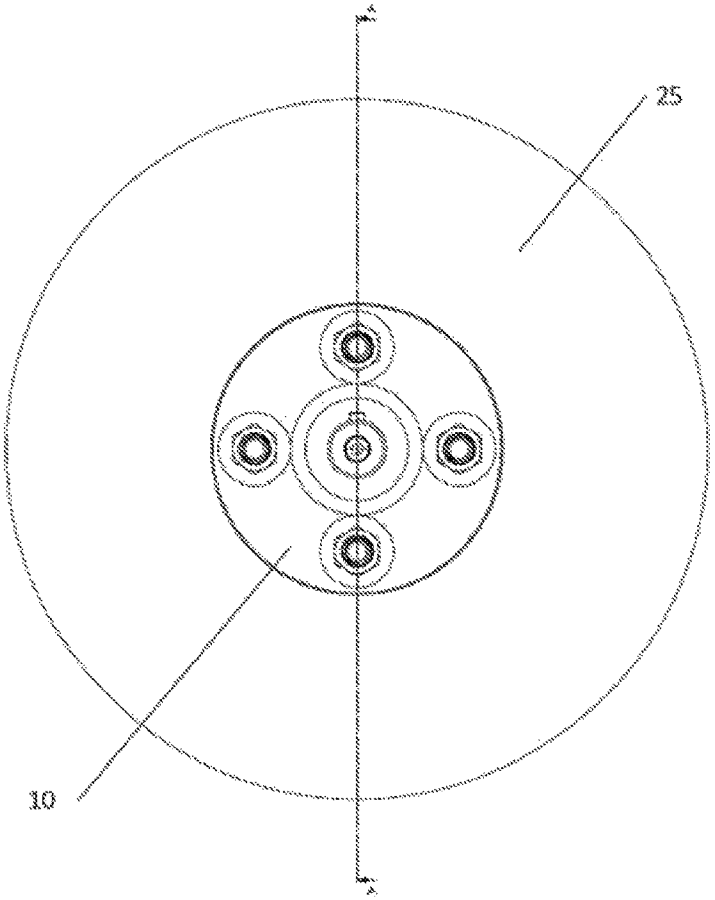
FIG. 5A is a top plan view of the resistance mechanism.

Looking now to FIGS. 3, 4A, 4B, 5A, 5B 6A and 6B, the resistance mechanism 10 is comprised of a friction sheave 25 having a tapered channel 30, two or more guide sheaves, 35 pressure compensating spool, a hydraulic pump 40 having a hydraulic pump shaft 44, a hydraulic reservoir 45 having an inlet 47 and an outlet 49, a flow adjustment mechanism 55 and a pressure compensated control valve 50. A looped length of climbing rope 15 feeds along the tapered channels 38 of the guide sheaves 35 and around a portion of the circumference of the friction sheave 25 such that the rope seats firmly within the tapered channel 30 of the friction sheave 25 as depicted in FIG. 4B. Excess rope may be kept out of the climber's way by placing it on the rope hanger 18. As the climber pulls on the rope 15, it seats more deeply within the tapered channel 30. The resulting friction between the rope 15 and friction sheave 25 causes the friction sheave 25 to rotate. A key 28 within the friction sheave 25 fits within a cavity 34 on the hydraulic pump shaft 44. As the climbing rope 15 is pulled, the friction sheave 25 begins to rotate, pumping pressurized fluid from the hydraulic reservoir 45 into the pressure compensated flow control (PCFC) valve 50 as illustrated in FIG. 12. Fluid flows from the outlet 49 of the hydraulic reservoir 45 into the hydraulic pump 40 where it is pumped into the entrance orifice 90 of the PCFC valve 50. It is this PCFC valve 50 that regulates the speed at which the friction sheave 25 rotates.

Figure 6B:
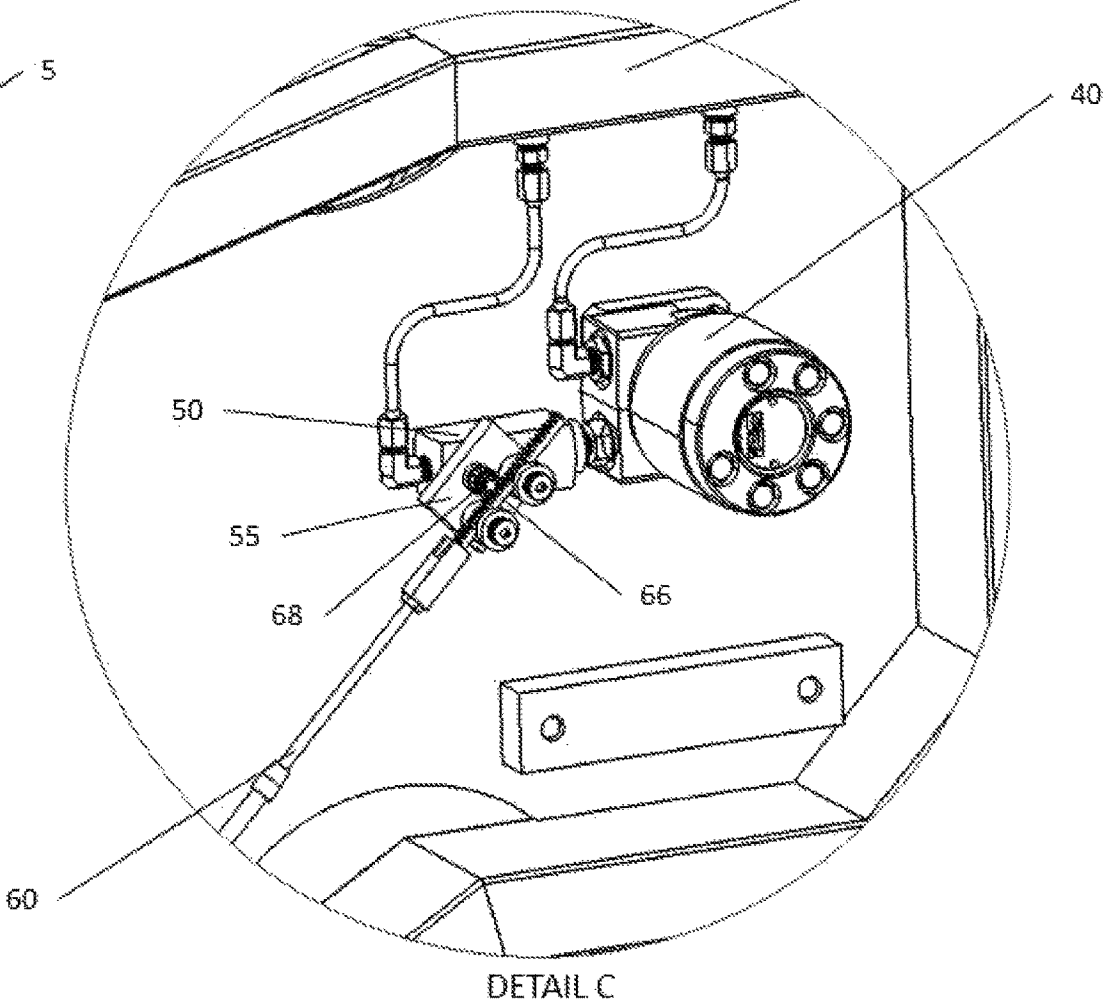
FIG. 6B is an expanded perspective view of the resistance mechanism highlighting an area of detail C shown in FIG. 6A.
Figure 6A:
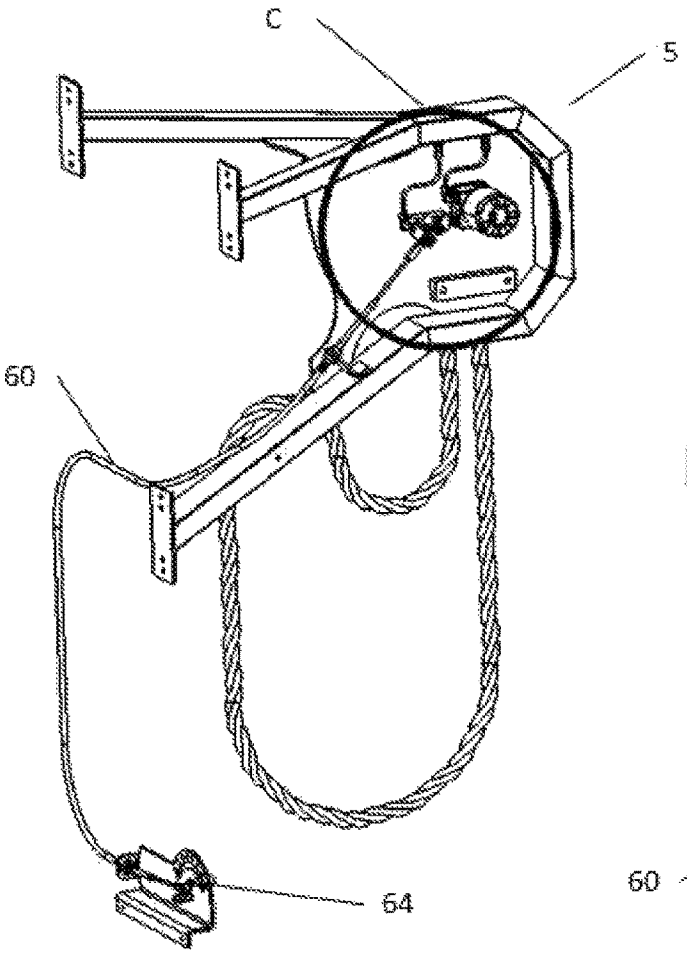
FIG. 6A is a left side elevational view of a wall mountable isokinetic rope climbing machine with detail C encircling the resistance mechanism.
Figure 7:
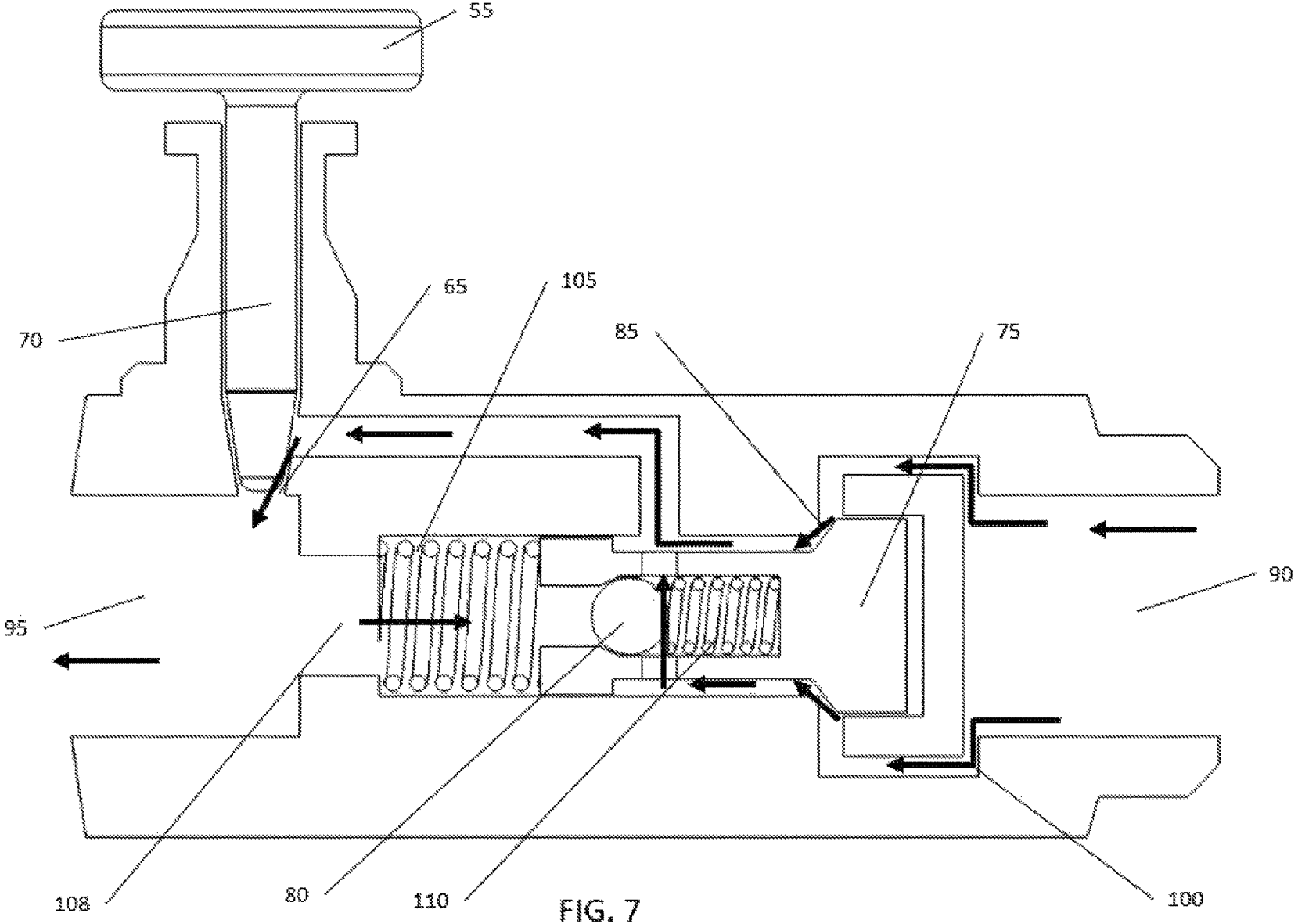
FIG. 7 is a detailed cross-sectional view of the pressure compensated flow control valve.

Referring now to FIGS. 6A, 6B and 7, a typical PCFC valve 50 is comprised of a flow adjustment mechanism 55, a flow rate orifice needle 70 seated within a flow rate orifice 65, a pressure compensating spool 75, a check valve 80, a variable pressure compensating orifice 85, a pressure adjustment chamber 100, a bias spring 105, and a ball check spring 110. The flow adjustment mechanism 55 determines the length of the flow rate orifice needle 70 that extends into the flow rate orifice 65, setting the system pressure drop across the flow rate orifice 65 thereby controlling the flow rate.

Referring now to the arrows depicting fluid movement in FIG. 7, fluid flows into the PCFC valve 50 at the fluid entrance orifice 90, passing through the variable pressure compensating orifice 85, past a pressure compensating spool 75, out through the flow rate orifice 65 and into the exit orifice 95. The exit orifice 95 is mechanically affixed to the inlet 47 of the hydraulic reservoir 45. See FIG. 6B. The pressure compensating spool 75 is attached to a ball check spring 110 and a check valve 80. The check valve 80 allows fluid to flow freely from the entrance orifice 90 to the exit orifice 95 while preventing fluid from moving in the opposite direction.

The bias spring 105 compensates for the pressure differential between the flow rate orifice 65 and the exit orifice 95. Pressure at the exit orifice 95 is transferred to the bias spring chamber 108, causing the bias spring 105 to either advance or retract within this chamber 108 thereby increasing or decreasing the spring force exerted on the bias spring 105. Incoming fluid at the entrance orifice 90 pushes the pressure compensating spool 75 forward until resistance from the bias spring 105 prevents further movement of the pressure compensating spool 75. The position of the pressure compensating spool 75 determines the volume of fluid within the pressure adjustment chamber 100, regulating fluid flow to the flow rate orifice 65 and thereby regulating the rotation of the hydraulic pump shaft 44 shown in FIG. 5B. Rotation of the friction sheave 25 is governed by the rotation of this hydraulic pump shaft 44, resulting in a constant rope speed for the selected flow setting. The sheave rotates in only one direction, allowing the climber to ascend on one side of the rope and descend on the other if desired.

Rope speed is determined by the fluid flow which may be selected by manually adjusting the flow rate orifice needle 70 position within the PCFC valve. Alternatively, the flow adjustment may be altered using a selector mechanism such as the rack and pinion control cable design depicted with more particularity in FIG. 6B. It should be recognized that a tie rod may be used in place of a control cable. In the embodiment shown in FIG. 6B, the flow adjustment mechanism 55 is comprised of a flow adjustment control cable 60 having a flow adjustment selector 64 on one end and a gear rack 66 on the other. The gear rack 66 is connected to a pinion 68 which is attached to the flow rate orifice needle 70. The length of the control cable 60 is shortened or lengthened depending on the setting chosen on the flow adjustment selector 64. The lateral movement of the control cable 60 and attached gear rack 66 is translated to the pinion 68, either tightening or loosening the attached flow orifice needle 70 depending on the direction of motion of the control cable 60. It should be recognized that other means may be used to select and adjust fluid flow into the PCFC valve 50.

FIGS. 1-3 illustrate a rope climbing machine having a wall-mounted support structure 20. FIGS. 8 and 9 depict a stand-mounted version of the machine. FIG. 9 shows the climbing machine with an optional free-standing stool 115 for those who would prefer to exercise from a seated position; however, it should be recognized that a fixed stool may be added to the support structure 20. FIG. 8 depicts the rope 15 threaded through a rope guide 120, orienting the rope 15 in a horizontal position. This rope orientation allows the user to sit on a stool 115 and pull the rope 15 in a tug-of-war fashion to exercise the shoulders, back and biceps. Alternatively, the user may lie on an elongated stool 115 and pull the rope 15 overhead and downward, exercising the shoulders, back and triceps.

FIG. 10 illustrates a space saving unit having a floor-mounted support structure 20 that is reduced in size. The climbing rope 15 hangs from a suspended rope handling mechanism 125 that can be mounted on a wall or ceiling. As with the wall-mounted version, the space saving support structure 20 houses the resistance mechanism 10, and speed adjustment selector 64. A looped section of rope is strung through one guide sheave 35, around the friction sheave 25 and through a second guide sheave 35. The rope 15 is threaded through the suspended rope handling mechanism 125 and hangs down for use by the climber.

FIG. 11 depicts a wall-hangable version of the rope climbing machine. This design is similar to the wall-mounted version shown in FIGS. 1-3, in that the looped length of rope 15 feeds along the guide sheaves 35 and around a portion of the circumference of the friction sheave 25, seating firmly within the tapered channel 30. The rope hangs below the friction sheave 25 and feeds through a rope guide 120. A flow adjustment selector 64 connected to the flow adjustment cable 60 determines the flow rate within the machine.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. A rope climbing apparatus comprising:

a. a support structure;

b. a friction sheave mounted to the support structure and having a tapered channel;

c. a climbing rope threaded about the friction sheave and seated within a portion of the tapered channel, friction between said climbing rope and tapered channel resulting in rotation of the friction sheave as force is applied to the climbing rope;

d. a hydraulic reservoir for retaining fluid in a hydraulic loop;

e. a hydraulic pump within said hydraulic loop and in fluid communication with the hydraulic reservoir and having a hydraulic pump shaft that is mechanically connected to the friction sheave such that the pump actuates and propels fluid as the friction sheave rotates; and f. a pressure compensated flow control valve within said hydraulic loop and in fluid communication with the hydraulic pump and hydraulic reservoir and comprising a fluid flow rate adjustment mechanism for selecting a climbing rope speed, a pressure adjustment chamber, and a pressure compensating spool in fluid communication with said pressure adjustment chamber, wherein the position of the pressure compensating spool shifts within the pressure compensated flow control valve in response to and in synchrony with an increase or decrease in pressure within the pressure adjustment chamber thereby maintaining a constant fluid flow rate within the hydraulic loop and subsequently allowing or inhibiting rotation of the hydraulic pump shaft to maintain a consistent climbing rope speed regardless of the magnitude of force applied to the climbing rope.

2. The rope climbing apparatus of claim 1, wherein at least two guide sheaves having tapered channels are mechanically affixed to the support structure adjacent to the friction sheave such that the climbing rope is threaded about the at least two guide sheaves and friction sheave.

3. The rope climbing apparatus of claim 1, wherein the climbing rope is comprised of a loop.

4. The rope climbing apparatus of claim 1, wherein the support structure is mounted to a wall or a ceiling.

5. The rope climbing apparatus of claim 1, wherein the support structure is affixed to a stand mount.

6. The rope climbing apparatus of claim 1, wherein the fluid flow rate adjustment mechanism is mechanically affixed to a pinion in a rack and pinion gearset, and wherein the rack is mechanically affixed to an adjustment selection cable such that the consistent climbing rope speed can be selected by shortening or lengthening said adjustment selection cable.

7. The rope climbing apparatus of claim 1, further comprising a stool.

8. The rope climbing apparatus of claim 1, further comprising a stool having a rope guide that aligns the climbing rope in a horizontal position.

9. The rope climbing apparatus of claim 1, wherein at least one rope guide is affixed to the rope climbing apparatus to support and guide the climbing rope movement.

10. A method for providing consistent climbing rope speed in a rope climbing machine regardless of a force applied by a climber, said method comprising:

a. Providing the rope climbing machine comprised of a support structure and a climbing rope speed regulating mechanism, the climbing rope speed regulating mechanism further comprising:

a friction sheave having a tapered channel mechanically affixed to a hydraulic pump via a hydraulic pump shaft;

fluid;

a hydraulic reservoir for retaining the fluid and in fluid communication with said hydraulic pump; and a pressure compensated flow control valve in fluid communication with the hydraulic pump and the hydraulic reservoir, wherein the pressure compensated flow control valve is comprised of a pressure compensating spool in fluid communication with a pressure adjustment chamber;

b. Providing a climbing rope threaded about said friction sheave and seated within a portion of the tapered channel;

c. Adjusting the climbing rope speed regulating mechanism to select a desired consistent climbing rope speed; and d. Applying force to the climbing rope whereby said applied force is transferred to the flow of fluid by the hydraulic pump, wherein said pressure compensating spool shifts in response to and in synchrony with an increase or decrease in pressure within said pressure adjustment chamber, thereby allowing or inhibiting rotation of the hydraulic pump shaft to maintain the consistent climbing rope speed regardless of the magnitude of force applied to the climbing rope.

* * * * *